US006315640B1

(12) United States Patent
Evertz et al.

(10) Patent No.: US 6,315,640 B1
(45) Date of Patent: Nov. 13, 2001

(54) METHOD FOR CUTTING METAL BODIES WITH A WATER JET

(75) Inventors: Egon Evertz; Rolf Seybold, both of Solingen (DE)

(73) Assignee: Egon Evertz KG (GmbH & Co.), Solingen (DE)

( * ) Notice: Subject to any disclaimer, the term of this patent is extended or adjusted under 35 U.S.C. 154(b) by 0 days.

(21) Appl. No.: 09/601,769

(22) PCT Filed: Feb. 11, 1999

(86) PCT No.: PCT/DE99/00409

§ 371 Date: Aug. 3, 2000

§ 102(e) Date: Aug. 3, 2000

(87) PCT Pub. No.: WO99/44793

PCT Pub. Date: Sep. 10, 1999

(30) Foreign Application Priority Data

Mar. 2, 1998 (DE) ..... 198 08 721

(51) Int. Cl.[7] ..... B24B 7/00; B24G 1/00
(52) U.S. Cl. ..... 451/38; 451/39
(58) Field of Search ..... 451/28, 75, 38, 451/39, 40

(56) References Cited

U.S. PATENT DOCUMENTS 4,389,261 6/1983 Donze et al. .
4,872,293 * 10/1989 Yasukawa et al. ..... 451/75

FOREIGN PATENT DOCUMENTS

| | | |
|---|---|---|
| 1 151 162 | 7/1963 | (DE) . |
| 2 207 260 | 10/1972 | (DE) . |
| 25 44 129 A1 | 4/1976 | (DE) . |
| 36 20 377 A1 | 12/1987 | (DE) . |
| 37 01 673 A1 | 8/1988 | (DE) . |
| 44 22 769 A1 | 1/1996 | (DE) . |
| 0 306 788 A2 | 3/1989 | (EP) . |
| 1 486 353 | 9/1977 | (GB) . |
| 08099299 | 4/1996 | (JP) . |
| 09108800 | 4/1997 | (JP) . |

OTHER PUBLICATIONS

"Trennen Durch Schneiden" by H. Benninghoff (Technische Rundschau No. 35/36 1997).

"Technische Textilien Mit Wasser Geschnitten" (Chemiefasern/Textilindustrie, 40/92, Year Mar. 1990.

EIN Comeback Für Die "Wasserlanze" by F.H. Kruse (Bekleidung+Wäsche 15/1985).

* cited by examiner

*Primary Examiner*—Derris H. Banks
(74) *Attorney, Agent, or Firm*—Herbert Dubno

(57) ABSTRACT

A method of cutting a body made of a metal or metal alloy which comprises heating the body to or drawing cutting to a temperature at least equal to 200° C. The metal body can be a continuously cast steel slab.

9 Claims, No Drawings

METHOD FOR CUTTING METAL BODIES WITH A WATER JET

CROSS REFERENCE TO RELATED APPLICATION

This application is a national stage of PCT/DE99/00409 filed Feb. 11, 1999 and based upon German National application 19808 721.7 filed Mar. 2, 1998 under the International Convention.

FIELD OF THE INVENTION

The invention relates to a method of cutting bodies made of metal or metal alloys by using a high-pressure water jet.

BACKGROUND OF THE INVENTION

As is already known from the DE 25 44 129 A1, the use liquid jets as a means for cutting or grinding various materials has been long known. The first publication about this topic deals with cutting rock formations and coal deposits. In addition to cutting with a continuous jet, cutting with a pulsed jet has proven itself useful because of the possibility to reach higher cutting and separating pressures. The speed at which the water jet leaves the nozzles amounts to at least 30 m/s. The pressures of the liquid are mostly in the order of magnitude of $3\times10^8$ Pa. Basically the cutting of metal bodies up to thickness of about 200 mm is also possible and has already been practiced. In order to enhance the cutting effect, it has been proposed to add to the liquid, mostly a water jet, a chemical additive or abrasive agent, e.g. garnet sand (see DE 44 22 769 A1). The disadvantage here is the relatively long cutting process. For this reason a cutting torch is used for cutting slabs.

OBJECT OF THE INVENTION

It is the object of the present invention to provide a cutting method using a high-pressure water jet, whereby the cutting speed in the case of metal or metal alloy pieces can be increased.

DESCRIPTION OF THE INVENTION

This object is achieved by heating the body to at least 200° C. According to the invention the body made of metal or metal alloy is heated prior to or during cutting to temperatures ≧200° C. Surprisingly it has been found that heatings of the body to temperatures of more than 200° C. increases the cutting speed considerably. Preferably temperatures above 400 to 600° C. and beyond can be used.

A particular application within the framework of the present invention consists in the cutting of a body made of metal or metal alloy, which can have a slab thickness of 20 cm to 25 cm. During continuous casting the liquid metal is cast into a water-cooled mold, from which the solidified part is continuously discharged during casting in the shape of blocks, bars, rods, billets, pipes or cylinders. The casting leaving the mold passes through a cooling zone where the casting is sprayed with water, which causes solidification also inside the casting. Drive rollers lead the casting to a cutting device, which according to the invention is arranged relatively close to the discharge nozzle and is a water-jet cutting device. In the cutting area the temperature of the cast goods lies at approximately 700° C.

The water pressure applied during cutting amounts to at least $3\times10^8$ Pa (3000 bar), preferably even higher, particularly it is up to $7\times10^8$ Pa (7000 bar). The water jet has a jet diameter of 25 $\mu$m to 0.4 mm and nozzle exit speed between 300 and 1200 m/s.

As basically known in cutting continuous castings, the high-pressure water-jet cutting device is entrained during cutting at the speed of the continuous cast profile, which at the same time is the discharge speed of the casting from the mold.

In a concrete application example, slabs with a thickness of 20 cm are cut by means of a water jet into desired lengths. The used water pressure amounted to $4\times10^8$ Pa. The exit speed of the water jet was approximately 1000 m/s.

It is self-understood that within the framework of the present invention, abrasive agents or chemicals enhancing the cutting effect can be added to the water or any liquid jet.

The device used according to the invention consists basically of an electric motor driving a hydraulic pump, which in turn feeds the liquid medium to a high-pressure booster. The water mostly used as liquid is discharged at high pressure through a nozzle, which has a discharge opening whose diameter is as small as possible.

What is claimed is:

1. A method of cutting a body made of metal or a metal alloy by using a high-pressure water-jet cutting device, wherein the body is heated prior to or during cutting to temperatures ≧200° C.

2. The method according to claim 1 wherein the body is heated to a temperature ≧600° C.

3. The method according to claim 1 wherein the body is a metal casting which is cut immediately after continuous casting by means of a water jet.

4. The method defined in claim 3 wherein said metal casting is a steel slab.

5. The method defined in claim 3 wherein during cutting the waterjet cutting device is entrained at the speed of the metal casting corresponding to the discharge speed thereof from a mold.

6. The method defined in claim 1 wherein the pressure used during waterjet cutting is at least $3\times10^8$ pa.

7. The method defined in claim 6 wherein the pressure used is about $7\times10^8$ pa.

8. The method defined in claim 1 wherein the waterjet has a diameter of 25 $\mu$m to 0.4 $\mu$m.

9. The method defined in claim 1 wherein the waterjet has an exit speed between 300 and 1200 m/s.

* * * * *